US005636600A

United States Patent [19]

Sweetland et al.

[11] Patent Number: 5,636,600

[45] Date of Patent: Jun. 10, 1997

[54] ROCKER LEVER ASSEMBLY FOR INTERNAL COMBUSTION ENGINE

[75] Inventors: Roger D. Sweetland; Fred M. Rasener, both of Columbus, Ind.

[73] Assignee: Cummins Engine Company, Inc., Columbus, Ind.

[21] Appl. No.: 550,737

[22] Filed: Oct. 31, 1995

[51] Int. Cl.[6] ..... F01L 1/18; F01L 1/26; F01M 9/10

[52] U.S. Cl. ..... 123/90.4; 123/90.41; 123/90.22; 123/90.36

[58] Field of Search ..... 123/90.22, 90.23, 123/90.27, 90.39, 90.4, 90.41, 90.33, 90.36

[56] References Cited

U.S. PATENT DOCUMENTS

| | | | |
|---|---|---|---|
| 3,428,032 | 2/1969 | Rudert | 123/90.4 |
| 3,967,601 | 7/1976 | Heberle | 123/90.39 |
| 4,655,177 | 4/1987 | Wells et al. | 123/90.36 |
| 4,671,222 | 6/1987 | Gallot et al. | 123/90.4 |
| 4,721,075 | 1/1988 | Kasai | 123/90.23 |
| 4,732,119 | 3/1988 | Melde-Tuczai et al. | 123/90.4 |
| 5,095,861 | 3/1992 | Dove, Jr. | 123/90.39 |
| 5,535,710 | 7/1996 | Zoschke et al. | 123/90.4 |

FOREIGN PATENT DOCUMENTS 79167 10/1951 Norway .

*Primary Examiner*—Weilun Lo

*Attorney, Agent, or Firm*—Sixbey, Friedman, Leedom & Ferguson, P.C.; Charles M. Leedom, Jr.; Joan K. Lawrence

[57] ABSTRACT

A rocker lever assembly for an internal combustion engine which employs four valves for each cylinder is provided. The rocker lever assembly includes a low cost support base formed of a sintered metal configured to support and precisely position an intake and an exhaust rocker arm in axially offset relative positions to provide driving connections between the engine pushrods and the cylinder valves.

15 Claims, 5 Drawing Sheets

ROCKER LEVER ASSEMBLY FOR INTERNAL COMBUSTION ENGINE

TECHNICAL FIELD

The present invention relates generally to rocker lever assemblies for internal combustion engines and specifically to an internal combustion engine rocker lever assembly with a simple, low-cost support structure which both supports and locates each individual rocker lever in an optimum operational location.

BACKGROUND ART

The precise positioning of rocker lever assemblies on an internal combustion engine is important both to the life of the rocker lever and the operation of the associated valves, fuel injectors and other structures. In addition, proper support for internal combustion engine rocker lever assemblies is essential if the rapid movement of the rocker levers and associated structures during engine operation is to be sustained. Provision of the desired alignment and necessary support for the rocker levers may be further complicated by the configuration of the engine cylinder head. Engine designs which employ four valves for each cylinder rather than the more commonly encountered two valves also present design challenges for the operative support of the rocker levers associated with these valves. Some engine designs require rocker lever support structures with complex shapes to locate the rocker levers in positions which will mesh with pushrods or other connecting elements. The shapes of such rocker lever supports may be sufficiently complex that they are extremely expensive to machine.

An engine which employs four valves for each cylinder must accommodate the rocker levers and supporting structure in a relatively limited area. Mounting each rocker lever on a single support provides more flexibility than mounting a pair of rocker levers on a single support.

The prior art has proposed rocker lever assemblies for internal combustion engines. U.S. Pat. No. 4,655,177 to Wells et at., for example, which is commonly owned by the assignee of the present invention, describes a rocker arm or lever support assembly. This support assembly includes a pedestal which mounts a pair of rocker levers on a single shaft. The lateral spacing between the rocker levers is chosen to conform to the locations of the pushrods and valve stems which engage the ends of each rocker lever. This rocker lever support arrangement is well suited to an engine configuration which employs only two valves for each cylinder. However, it will not work effectively with an engine configuration that requires both four valves per cylinder and the locations of the rocker lever ends to mesh with existing parts.

U.S. Pat. No. 4,732,119 to Melde-Tuczai et al. discloses rocker lever supports for an internal combustion engine with two or more valves per cylinder. Each rocker lever is individually mounted on a separate support structure. However, these rocker levers are directly actuated by contact with cams on a rotating camshaft, which presents drastically different engine design considerations from optimally positioning and mounting rocker levers on the cylinder head to actuate four valves per cylinder in a compression ignition engine.

U.S. Pat. No. 4,721,075 to Kasai discloses individually mounted rocker lever supports for a two valve engine configuration.

Norwegian Patent No. 79167 to Pielstick discloses a rocker lever support assembly that mounts and supports rocker levers capable of actuating four valves. However, this complex arrangement, which would be expensive to manufacture, mounts two parallel rocker levers on a single shaft and a third rocker modified to actuate two valves on a separate shaft. This arrangement, moreover, fails to provide a low cost solution to the optimal location and support for the rocker levers required to actuate four valves in each engine cylinder.

The prior art, therefore, has failed to provide a simple, low cost rocker lever support assembly that can be mounted on an engine cylinder head so that the rocker lever assembly components are capable of meshing with existing engine parts to optimally position and support the rocker levers required to actuate four valves for each engine cylinder. A need exists for such a rocker lever support assembly.

SUMMARY

It is a primary object of the present invention, therefore, to overcome the disadvantages of the prior art and to provide a simple, low cost rocker lever support assembly which individually mounts and supports on the engine cylinder head the rocker levers and associated components required to actuate four valves for each engine cylinder.

It is another object of the present invention to provide a low cost sintered support for mounting a single rocker lever in an optimal valve actuating position relative to several other rocker levers in a diesel engine.

It is yet another object of the present invention to provide a rocker lever support assembly for a pair of rocker levers capable of meshing with existing engine components to actuate four valves associated with each engine cylinder.

The aforesaid objects are achieved by providing a simple, low cost rocker lever support assembly capable of supporting on an engine cylinder head in optimal actuating positions with existing engine valve actuating components a pair of rocker levers which actuate four engine cylinder valves for each cylinder. The rocker lever assembly includes a support base secured to the engine cylinder head which is configured to support and position in an offset relationship two separate pedestals and shafts on each of which is mounted for reciprocal motion a rocker lever optimally positioned to actuate a pair of engine cylinder valves. The support base is formed from a sintered metal.

Other objects and advantages will be apparent from the following description, claims and drawings.

DESCRIPTION OF THE PREFERRED EMBODIMENTS

The location of engine components so that they will function with optimal efficiency is often limited by design considerations which must allow for the positions of other engine components that cannot be moved or relocated. When an engine is redesigned to accommodate four valves for each cylinder instead of the usual two valves, there are certain drive train and valve actuating structures that cannot be moved. This requires the modification of other drive train and valve actuating structures to ensure that the valves operate with optimal efficiency. The location of the pushrod, for example, is relatively fixed and unchangeable. As a result, the rocker levers employed to provide the driving connection between the pushrods and the valves must be positioned so that one end of a rocker lever can be contacted by a pushrod and so that the other end of a rocker lever can contact the crosshead or other structure required to actuate two of the four valves associated with each cylinder. The requirement that the rocker levers mesh with existing engine parts, coupled with the space constraints presented by the engine cylinder head would appear to dictate a complex supporting structure for the pair of rocker levers needed for each set of four cylinder valves. The present invention provides a low cost support base for a rocker lever assembly that both locates the shafts supporting the individual rocker levers and provides the proper axial location for the rocker levers. Although the shape of the rocker lever support structure appears complex, this design actually allows the cost to be kept down since the support can be sintered rather than machined. The rocker lever assembly of the present invention also effectively mounts a pair of rocker levers so that the rocker levers reciprocate freely during engine operation and avoid contact with such structures as valve springs.

The present design employs individual rocker levers, each individually mounted on its own shaft and pedestal to reciprocate about the axis of this shaft. A single support structure supports the individual shafts and pedestals for the two rocker levers required to actuate the four valves associated with each cylinder. This arrangement provides a flexibility not heretofore achieved with existing rocker lever support assemblies.

Figures 1A, 1B:
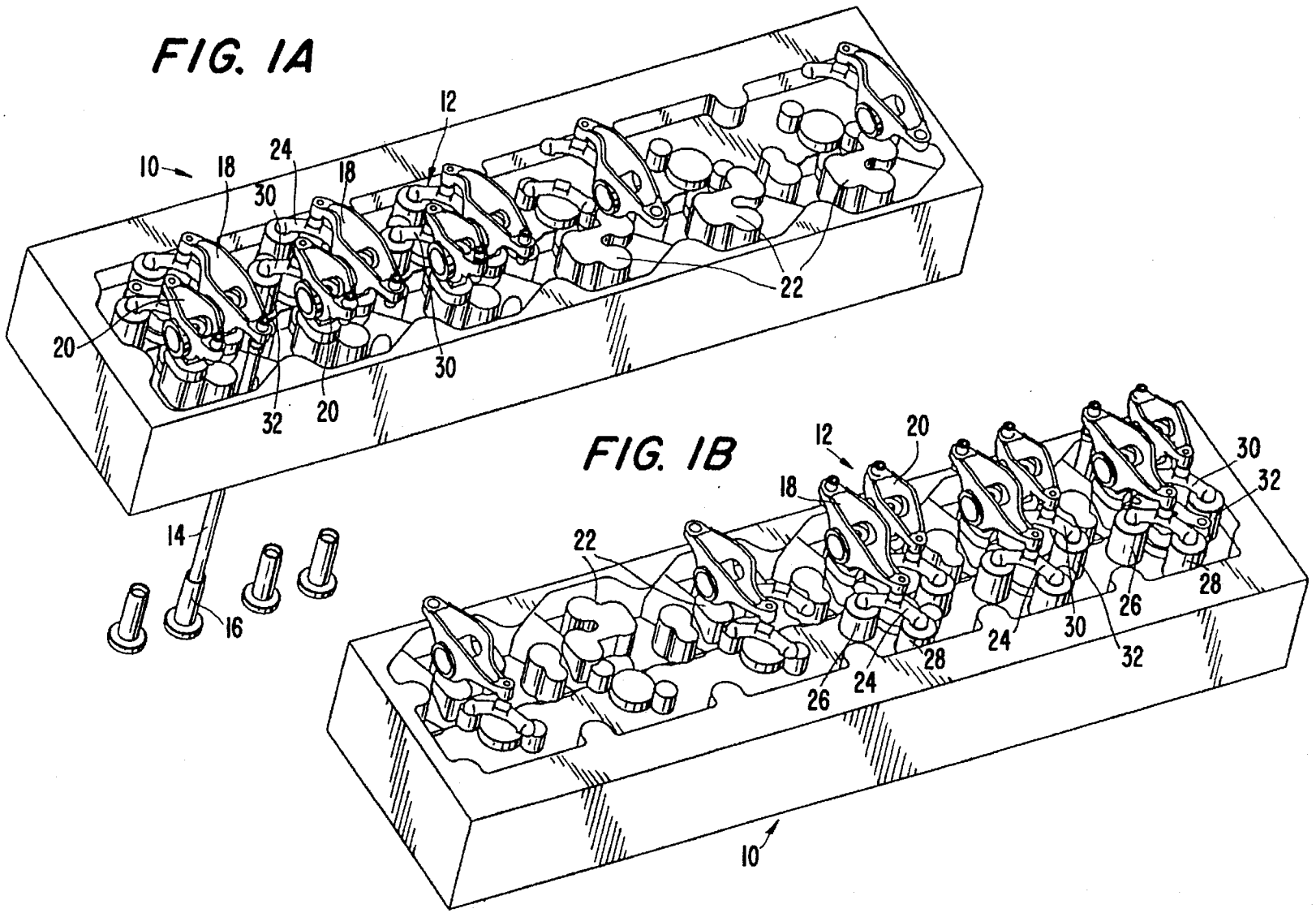
FIG. 1A is a top perspective view of an engine cylinder head showing positioning support bases and rocker lever assemblies in accordance with the present invention mounted on the cylinder head, wherein one rocker lever is shown contacting one of the engine pushrods.
FIG. 1B is a top perspective view of the engine cylinder head, positioning support pedestals, and rocker lever assemblies of FIG. 1A as seen from the opposite direction as FIG. 1A.

Referring to the drawings, FIGS. 1A and 1B illustrate two opposite perspective views of an engine cylinder head 10 on which are mounted several rocker lever assemblies 12 according to the present invention. In FIG. 1A the cylinder head is viewed from the pushrod side of the engine drive train, and in FIG. 1B the cylinder head is viewed from the valve side of the engine drive train. The size and configuration of the engine cylinder head relative to the main components in the engine drive train are not susceptible to a great deal of variation. In addition, the positions of certain drive train components, for example, the pushrod 14 which forms a link between the solid tappet 16 and the exhaust valves (not shown) actuated by the rocker lever assembly 12, are relatively fixed. Although a solid tappet 16 and its associated pushrod 14 are shown herein, the rocker lever assembly of the present invention can be used effectively with other like structures, such as, for example, hydraulic tappets. Therefore, the rocker lever assembly 12 of the present invention has been designed to provide the necessary operative connections within the confines of the cylinder head configurations and dimensions. The configuration of the rocker lever support bases, moreover, allows the precise positioning of the rocker levers on the engine cylinder head.

Each rocker lever assembly 12 includes a pair of rocker arms 18 and 20 which reciprocate or pivot about an axis that is substantially parallel to the longitudinal axis of the cylinder head to raise and lower intake and exhaust valves in response to the movement of the engine drive train. It can be seen in FIGS. 1A and 1B and more clearly in others of the drawings that the axes about which each of the rocker arms 18 and 20 reciprocates are not coaxial or aligned, but are slightly offset from each other. This offset mounting of the rocker arms provides maximum flexibility for locating the rocker arms in position that will provide the necessary meshing connections in an engine drive train with four valves in each cylinder. A support base 22 having the complex configuration shown is formed and secured to the cylinder head 10.

The configuration of the support base 22 accommodates an exhaust rocker lever 18 connected through a crosshead 24 to two exhaust valves 26 and 28 and an intake rocker lever 20 connected through a crosshead 30 to two intake valves, only one valve 32 being shown in FIGS. 1A and 1B. The support base 22 precisely positions the rocker levers 18 and 20 so that each is able to make the necessary driving connections between its respective pushrod 14 and crosshead piece 24, 30. The space available on the engine cylinder head for accommodating all of these structures in their proper orientation is limited. However, the inventors have designed a rocker lever assembly support base 22 which not only meets all of the requisite design constraints, but is low in cost despite its complex shape. The support base 22, which is preferably formed of iron or steel, does not require costly machining, but can be sintered. Each of the exhaust rocker levers 18 can be individually mounted on the support base 22 relative to its corresponding intake rocker lever 20, as will be explained in detail below, in the offset arrangement shown to mesh effectively with the engine drive train pushrods and valves.

Figure 2:
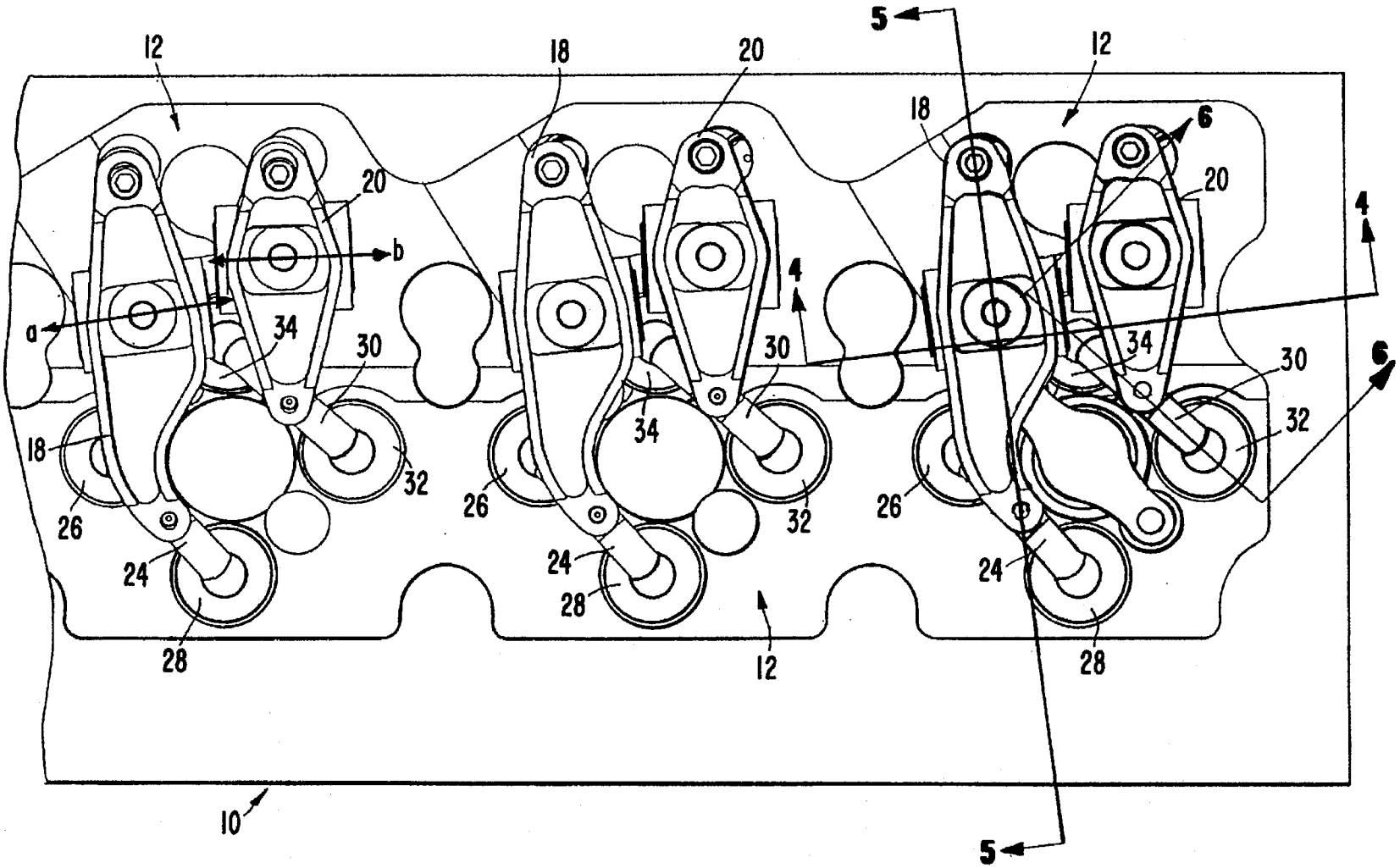
FIG. 2 is a top view of an engine cylinder head showing three rocker lever assemblies in accordance with the present invention.

FIG. 2 is a top view of one end of an engine cylinder head 10 showing the positions of three rocker lever assemblies 12, each of which includes an exhaust rocker lever or arm 18 and an intake rocker lever or arm 20. The offset relationship of the axis of rotation a for the exhaust rocker arm 18 relative to the axis of rotation h for the intake rocker arm 20 can be clearly seen at the left end of FIG. 2. In addition, the different configurations for each exhaust rocker arm 18 and each intake rocker arm 20 required to provide the necessary meshing engagement with both the pushrods and the valve crossheads while avoiding other engine components can be clearly seen in FIG. 2. The exhaust rocker arms 18 are somewhat larger and differently shaped than the intake rocker arms 20.

Figure 3:
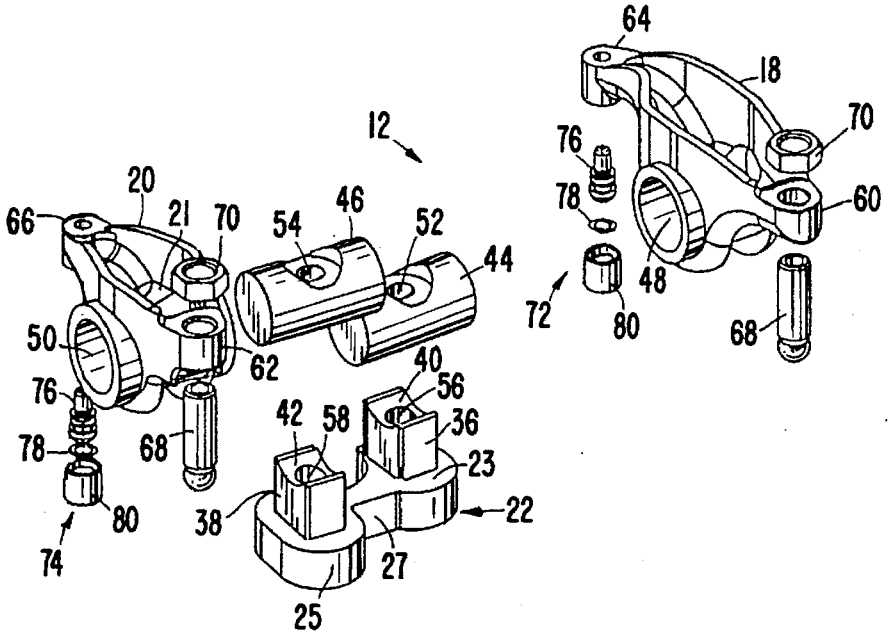
FIG. 3 is an exploded perspective view of a rocker lever assembly according to the present invention.

FIG. 3 illustrates, in exploded perspective view, the main components of a rocker lever assembly 12 in accordance with the present invention. The configuration of the support base 22 which mounts the intake and exhaust rocker levers in axially offset positions so that the rocker levers provide optimum driving connections between the pushrods and the intake an exhaust valves can be clearly seen in FIG. 3. Each support base 22 includes an exhaust rocker arm supporting pad 23 and an intake rocker arm supporting pad 25 connected by a bridge section 27. This configuration was designed to permit the precise mounting of a pair of rocker levers, but with the flexibility allowed when each rocker lever is mounted on a separate shaft. On the exhaust rocker arm supporting pad 23 and the intake rocker arm supporting pad 25 are mounted two pedestals 36 and 38, respectively, each pedestal having a concave upper surface 40, 42, with a radius of curvature sized to receive, respectively, a substantially cylindrical shaft 44, 46. Each shaft 44, 46 is rigidly clamped to its respective pedestal 36, 38, and to the cylinder head 10 through the support base 22. The pedestal 36 and shaft 44 mount the exhaust rocker arm 18 to the pad 23, and the pedestal 38 and shaft 46 mount the intake rocker arm 20 to the pad 25. Each rocker arm 18, 20 includes a respective mounting bore 48, 50. The cylindrical shaft 44 extends through the bore 48 to mount rocker arm 18 to the pedestal 36, and the cylindrical shaft 46 extends through the bore 50 to mount rocker arm 20 to the pedestal 38. Mounting bolts (not shown) are employed to rigidly secure each cylindrical shaft 44, 46 to its respective pedestal. Bolt-receiving holes 52 and 54 are provided in cylindrical shafts 44 and 46 to align with the bolt-receiving holes 56 and 58 in the pedestals 36 and 38 and, thus, secure the rocker arm supporting structures to the support base 22 so that the rocker arms 18 and 20 are correctly oriented to engage a respective pushrod and pair of valves.

Each rocker arm 18, 20 has a pushrod contacting end 60, 62 and a valve crosshead contacting end 64, 66. To each pushrod contacting end 60, 62 is secured a rocker lever adjusting screw 68, preferably by a jam nut 70. The valve crosshead contacting ends 64 and 66 are secured to crosshead fastening assemblies 72 and 74, respectively. Each crosshead fastening assembly preferably includes a rocker lever ball 76, an O-ring seal 78, and a rocker nose pivot 80.

Figure 4:
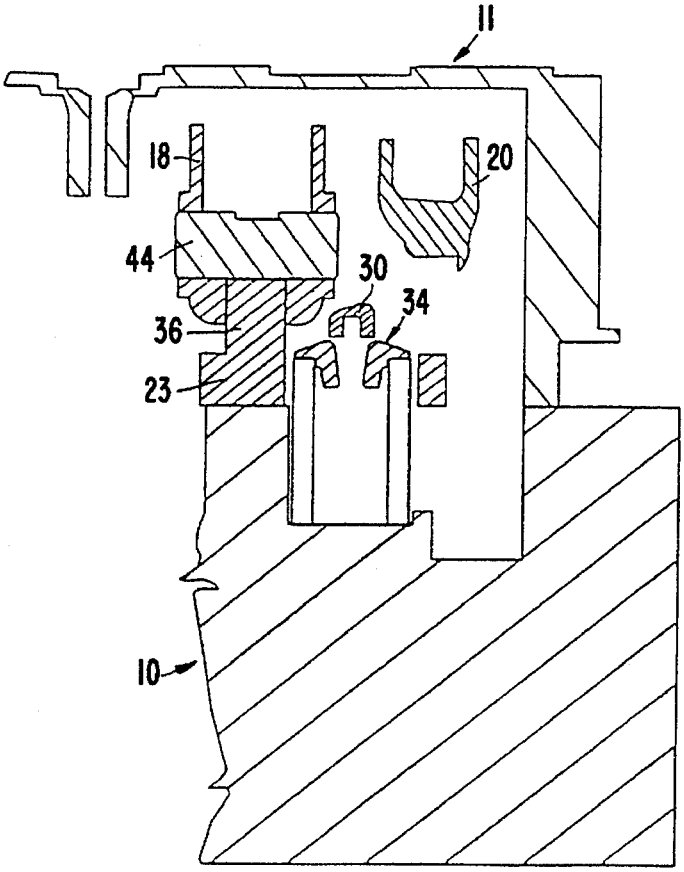
FIG. 4 is a cross-sectional view of the engine cylinder head of FIG. 2 taken along line 4—4.

FIG. 4 illustrates a cross-sectional view of the rocker lever assembly of the present invention along line 4—4 of FIG. 2. This view shows the locations of intake rocker arm 20 and exhaust rocker arm 18 relative to valve 34. A cover 11 is shown over the rocker lever assembly.

Figure 5:
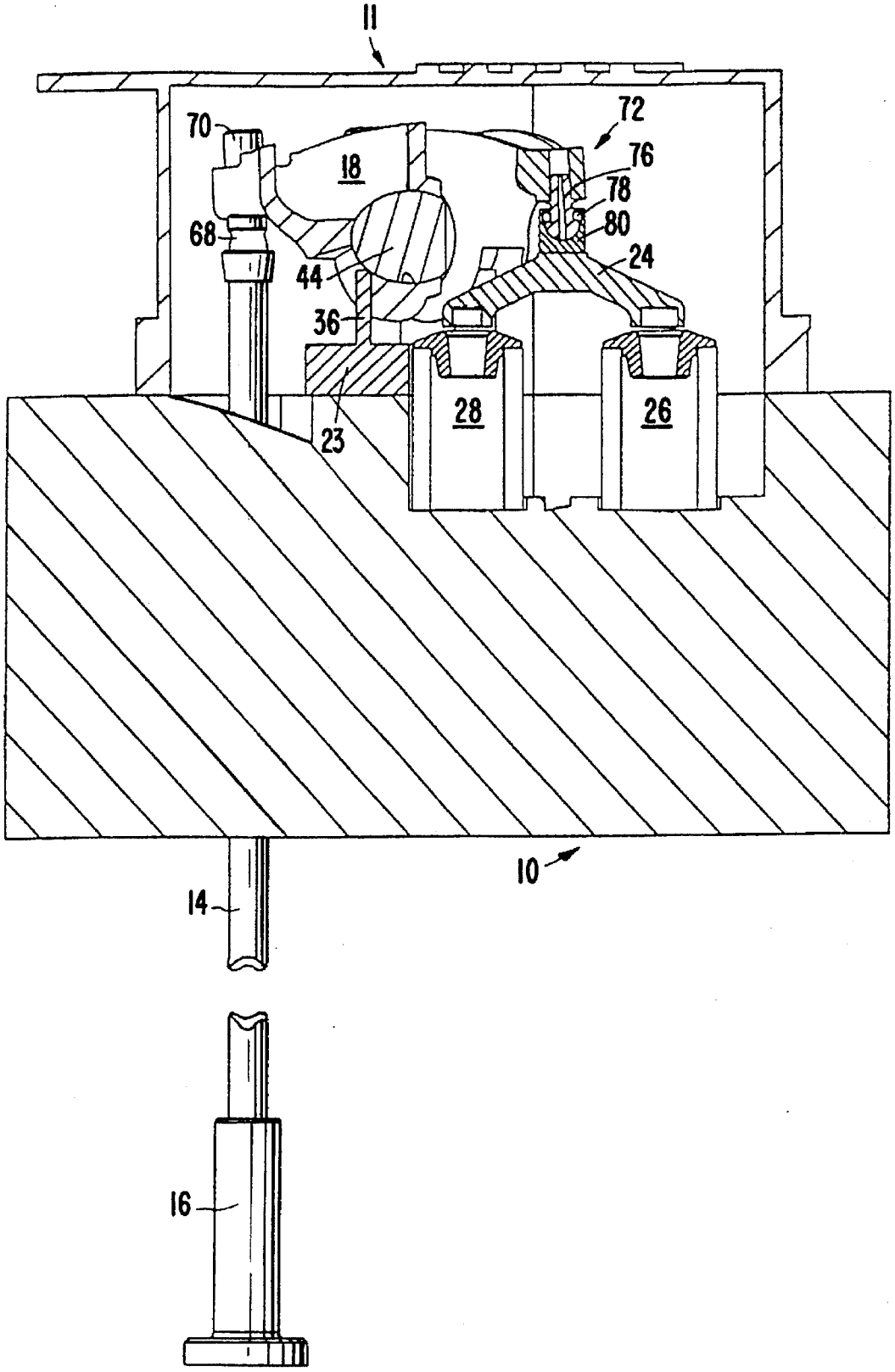
FIG. 5 is a cross-sectional view of the engine cylinder head of FIG. 2 taken along line 5—5.

FIG. 5 illustrates a cross-sectional view of the rocker lever assembly of the present invention along line 5—5 of FIG. 2. The connections between exhaust rocker arm 18, the pushrod 14 and tappet 16 and the exhaust valves 26 and 28 are shown in detail in FIG. 5.

Figure 6:
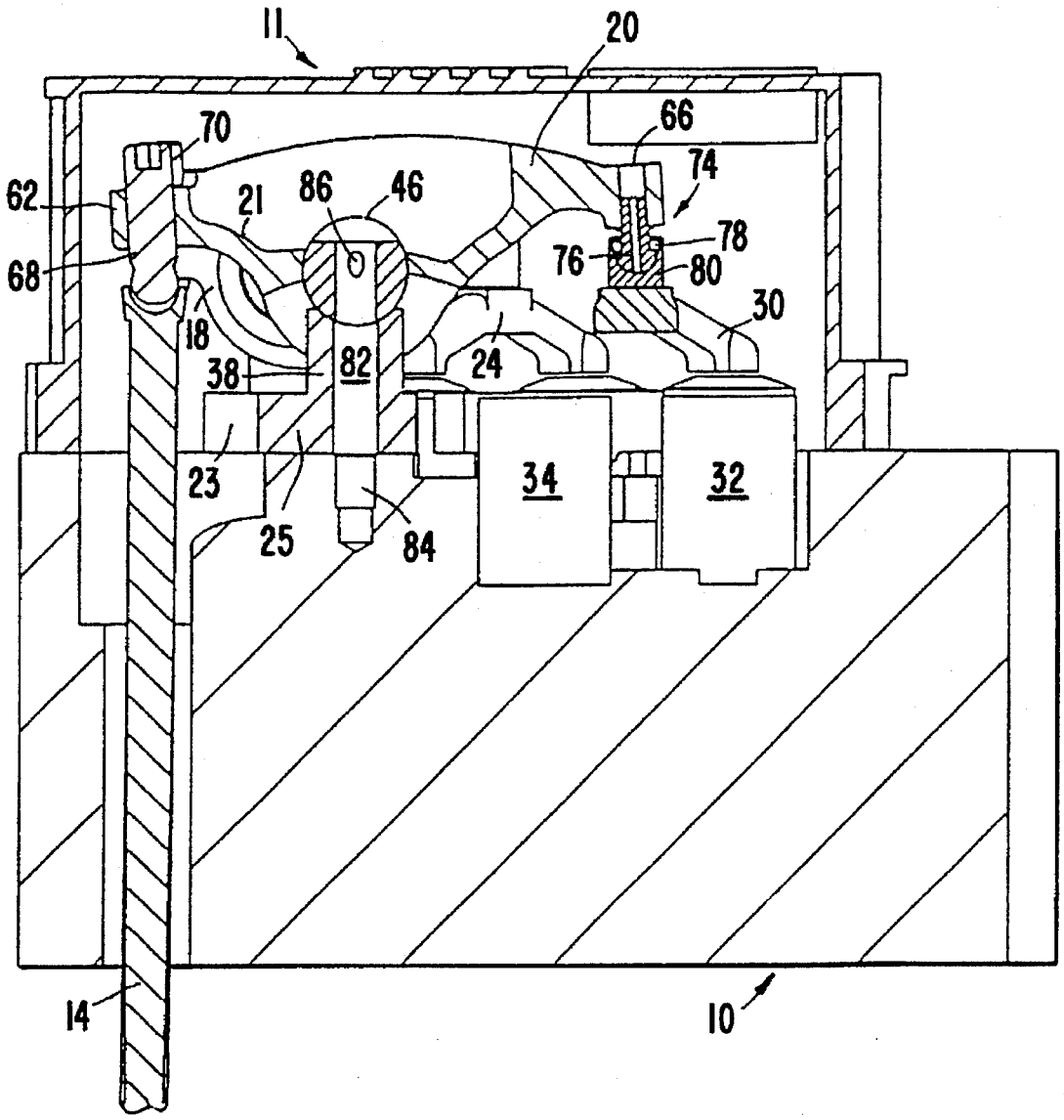
FIG. 6 is a cross-sectional view of the engine cylinder head of FIG. 2 taken along line 6—6.

FIG. 6 illustrates a cross-sectional view of the rocker lever assembly of the present invention along lines 6—6 of FIG. 2. The connections between the intake rocker arm 20, the pushrod 14, and the intake valves 32 and 34 through the crosshead 30 are shown in detail in FIG. 6. FIG. 6 shows, in addition, the lubrication passage structures used to provide lubricant to the shaft 46 and to the intake rocker arm 20. A lubricant channel 82 in the support base 22 and pedestal 38 communicates with a lubricant bore 84 in the engine cylinder head 10. The lubricant bore 84 conducts lubricant from the engine lubricant supply (not shown) into the lubricant channel 82 and to the shaft 46 and rocker arm 20 through a port 86. As the rocker arm 20 reciprocates on the shaft 46, lubricant flows about the shaft 46 and onto the interior upper surface 21 of the intake rocker arm 20. The shaft 44 for the exhaust rocker arm 18 includes a similar lubrication channel and port (not shown).

Industrial Applicability

The rocker lever support assembly of the present invention will find its primary applicability in mounting intake and exhaust rocker arms on the cylinder head to provide the requisite operative driving connections between pushrods and cylinder valves in an internal combustion engine, particularly a compression ignition or diesel engine, which employs four valves for each engine cylinder.

We claim:

1. A rocker lever assembly for an internal combustion engine mounted on an engine cylinder head to provide the driving connections between associated engine pushrods and a pair of intake valves and a pair of exhaust valves associated with a single engine cylinder, said rocker lever assembly comprising:

(a) an intake rocker arm drivingly connected at one end to a pushrod and at an opposite end to the pair of intake valves;

(b) an exhaust rocker arm drivingly connected at one end to a pushrod and at an opposite end to the pair of exhaust valves;

(c) a support base mounted on the engine cylinder head and including an intake rocker arm support pad section and an exhaust rocker arm support pad section connected by a bridge section, wherein said support base is configured so that the intake rocker arm support pad section is asymmetrically offset from the exhaust rocker arm support pad section;

(d) an intake rocker arm pedestal mounted on the intake rocker arm support pad section configured to receive an intake rocker arm shaft; and (e) an exhaust rocker arm pedestal mounted on the exhaust rocker arm support pad section configured to receive an exhaust rocker arm shaft, wherein said intake rocker arm is pivotally mounted on said intake rocker arm shaft and said exhaust rocker arm is pivotally mounted on said exhaust rocker arm shaft so that the pivotal axis of said intake rocker arm is linearly offset from the pivotal axis of said exhaust rocker arm and each said rocker arm is optimally positioned to pivot freely between its associated pushrod and pair of valves during engine operation.

2. The rocker lever assembly described in claim 1, wherein said support base is formed of sintered metal.

3. The rocker lever assembly described in claim 2, wherein said support base is formed of iron or steel.

4. The rocker lever assembly described in claim 2, wherein said intake rocker arm is drivingly connected to a valve crosshead element connected to a pair of intake valves, and said exhaust rocker arm is drivingly connected to a valve crosshead element connected to a pair of exhaust valves.

5. The rocker lever assembly described in claim 4, wherein said intake rocker arm pedestal and said intake rocker arm shaft are rigidly secured to said intake rocker arm support pad section and said exhaust rocker arm pedestal and said exhaust rocker arm shaft are rigidly secured to said exhaust rocker arm pad section.

6. The rocker lever assembly described in claim 5, wherein said intake rocker arm support pad section and said intake rocker arm pedestal and said exhaust rocker arm support pad section and said exhaust rocker arm pedestal each include lubrication channels for providing a supply of lubricant to each of said intake rocker arm shaft and said exhaust rocker arm shaft as each rocker arm pivots about its respective shaft.

7. A support base for an internal combustion engine rocker lever assembly including an intake and an exhaust rocker lever, each said rocker lever being pivotally mounted on a shaft in a proper axial location on a respective support pedestal on said support base in an optimum operating position to provide the driving connection between an engine pushrod and a pair of intake or a pair of exhaust valves, said support having a planar configuration wherein an intake rocker lever support section of said support is connected by a bridge section and positioned relative to an exhaust rocker lever support section so that the center of said intake rocker lever support section is asymmetrically offset from and not aligned with the center of said exhaust rocker lever, and the pivotal axis of the intake rocker lever shaft is linearly offset from the pivotal axis of the exhaust rocker lever shaft.

8. The support base described in claim 7, wherein said support base is formed of sintered metal.

9. The support base described in claim 8, wherein said support base is form of iron or steel.

10. An internal combustion engine including a drive train and a plurality of cylinders in communication with a cylinder head, wherein each cylinder has associated therewith a pair of intake valves and a pair of exhaust valves, each of said pair of intake and said pair of exhaust valves being operatively connected to the engine drive train by a rocker lever assembly, wherein said rocker lever assembly comprises:

(a) an intake rocker arm positioned to provide the driving connection between a pushrod and the pair of intake valves;

(b) an exhaust rocker arm positioned to provide the driving connection between a pushrod and the pair of exhaust valves; and (c) a support base configured to mount the intake rocker arm on an intake rocker arm support pad section at a location asymmetrically offset from and connected to an exhaust rocker arm support pad section on which is mounted the exhaust rocker arm, wherein said intake rocker arm is pivotally mounted on a shaft on an intake rocker arm pedestal on said intake rocker arm support pad and said exhaust rocker arm is pivotally mounted on a shaft on an exhaust rocker arm pedestal on said exhaust rocker arm support pad so that the pivotal axis of said intake rocker arm shaft is linearly offset from the pivotal axis of said exhaust rocker arm shaft and each said rocker arm is optimally positioned to reciprocate freely between its associated pushrod and pair of valves during engine operation.

11. The internal combustion engine described in claim 10, wherein said rocker lever assembly support base is formed of sintered metal.

12. The internal combustion engine described in claim 10, wherein said rocker lever assembly support base is formed of iron or steel.

13. The internal combustion engine described in claim 11, wherein said intake rocker arm is drivingly connected to a valve crosshead element connected to a pair of intake valves, and said exhaust rocker arm is drivingly connected to a valve crosshead element connected to a pair of exhaust valves.

14. The internal combustion engine described in claim 13, wherein said intake rocker arm pedestal and said intake rocker arm shaft are rigidly secured to said intake rocker arm support pad section and said exhaust rocker arm pedestal and said exhaust rocker arm shaft are rigidly secured to said exhaust rocker arm pad section.

15. The internal combustion engine described in claim 14, wherein said intake rocker arm support pad section and said intake rocker arm pedestal and said exhaust rocker arm support pad section and said exhaust rocker arm pedestal each include lubrication channels for providing a supply of lubricant to each of said intake rocker arm shaft and said exhaust rocker arm shaft as each rocker arm pivots about its respective shaft.

* * * * *